US006390916B1

(12) United States Patent
Brown

(10) Patent No.: US 6,390,916 B1
(45) Date of Patent: May 21, 2002

(54) SEAL CARD GAME SYSTEM

(76) Inventor: Charles E. Brown, 5600 Main St., North Ridgeville, OH (US) 44039

( * ) Notice: Subject to any disclaimer, the term of this patent is extended or adjusted under 35 U.S.C. 154(b) by 0 days.

(21) Appl. No.: 09/815,206

(22) Filed: Mar. 22, 2001

Related U.S. Application Data

(63) Continuation-in-part of application No. 09/747,458, filed on Dec. 22, 2000.

(51) Int. Cl.[7] ..... A63F 3/06
(52) U.S. Cl. ..... 463/17; 273/139
(58) Field of Search ..... 463/17, 18, 19; 273/139

(56) References Cited

U.S. PATENT DOCUMENTS

| | | | | |
|---|---|---|---|---|
| 4,252,322 A | | 2/1981 | Orter | |
| 4,775,155 A | | 10/1988 | Lees | |
| 4,871,172 A | | 10/1989 | Hwang | |
| 4,943,090 A | * | 7/1990 | Fienberg | 273/139 |
| 5,046,737 A | | 9/1991 | Fienberg | |
| 5,074,566 A | | 12/1991 | Desbiens | |
| 5,106,090 A | | 4/1992 | Greenwood | |
| 5,129,652 A | | 7/1992 | Wilkinson | |
| 5,158,293 A | | 10/1992 | Mullins | |
| 5,407,200 A | | 4/1995 | Zalabak | |
| 5,613,679 A | | 3/1997 | Casa et al. | |
| 5,671,921 A | | 9/1997 | Quinlan | |
| 5,743,524 A | | 4/1998 | Nannicola | |
| 5,931,468 A | | 8/1999 | Orolin | |
| 5,934,671 A | | 8/1999 | Harrison | |
| 6,305,687 B1 | * | 10/2001 | Pollock et al. | 273/269 |
| 6,309,298 B1 | * | 10/2001 | Gerow | 463/20 |

FOREIGN PATENT DOCUMENTS

GB 2163663 A 8/1994

OTHER PUBLICATIONS

"Pulltab Express" retrieved from the internet on Nov. 15, 2001. URL:<http://www.pulltab.com>.*
"Charity game ticket standards" retrieved from the internet on Nov. 15, 2001. URL<:http://www.Irc.state.ky.us/kar/820/001/030.htm>.*

* cited by examiner

*Primary Examiner*—Valencia Martin-Wallace
*Assistant Examiner*—Julie Brocketti
(74) *Attorney, Agent, or Firm*—Watts, Hoffmann, Fisher & Heinke Co., LPA

(57) ABSTRACT

A seal card game system providing multiple levels of non-progressive play. The game system awards a master case award to a winning ticket not among the population of individual deal winning tickets. A winning ticket of each deal set does not qualify for the master case award level. The game features segregated deal sets, each set containing break-open tickets. Each deal set is segregated by deal identifier indicia. In one exemplary embodiment, the deal identifier indicia is a selected color which is imprinted on each of the playing tickets comprising a deal set. The play tickets may be serialized by deal or by case for security. A seal card may includes the serialization of each ticket associated with the case. The non-progression scheme benefits the game operator in retaining the interest and participation of a higher population of players throughout the multiple deal play.

17 Claims, 6 Drawing Sheets

7
8a
8b
8c
8d
8e
10
8f
8g
8h
8k
8l
8p
8q
8r
8s
8t
8m
8n
8o
8j
8i
DEAL SEAL CARD
50
MASTER SEAL CARD
80

100
101a
101b
101c
110
101d
101e
101f
150
SEAL CARD
151

SEAL CARD GAME SYSTEM

CROSS-REFERENCE TO RELATED APPLICATIONS

This application is a continuation-in-part of U.S. patent application Ser. No. 09/747,458 entitled "Seal Card Game System with Non-Progressive Multiple Winning Levels," filed on Dec. 22, 2000. The '458 application is incorporated herein in its entirety by reference.

FIELD OF THE INVENTION

The present invention relates generally to instant ticket game systems, and more specifically, the invention is directed to a seal card game system having multiple levels of integrated, non-progressive play.

BACKGROUND ART

Games of chance continue to be very popular in our culture. Certain games of chance, such as instant ticket games or pull tab tickets games have gained popularity with social, fraternal, or church organizations seeking to raise funds. Commercial bingo halls also feature similar games of chance. Game operators in these facilities have a multitude of game systems from which to chose. Some new game systems enjoy most success, while many others fail to be commercially viable. The ability of a game system to generate player excitement and prolonged interest will ultimately determine the commercial success of the game system.

Many games known in the art feature a deal set of play tickets, e.g., 100 individual tickets which comprise a deal set, which are individually sold to players for a small fee. Each player breaks open one or more pull tabs of the ticket to reveal game symbols imprinted on the ticket. Some game systems feature instant winnings based on the imprinted game symbol or symbols while others feature qualifying symbols, identifying eligibility to compete in an award level associated with the particular deal set. After all tickets in the deal set are sold, players holding a ticket eligible for the deal set award are recorded on a deal seal card. The game operator will open a pull tab on the deal seal card to reveal the deal set winner. A deal winner may receive cash, prizes, or additional tickets.

Some game systems in the prior art feature a case award in addition to a deal award. In this type of game system, a case set of tickets are sold by the operator. The case includes a plurality of deal sets of tickets, e.g. 10 deal sets in one case with each deal set having a predetermined number of tickets, e.g. 100 tickets. After all tickets in the case are sold and each of the deal set winners is determined, some or all of the deal winners further compete for higher level awards, e.g., a case award. This is commonly referred to as a progressive scheme or progressive game system. That is to say, the tickets qualifying for a case award must first have been deal set award winners. Progressive game systems of this type retain the interest of individual deal set winners but often at the expense of players not holding deal set winning tickets.

U.S. Pat. No. 5,046,737 to Fienberg discloses a similar game system with multi-level playing. One embodiment of the game features play tickets with numbers ending in "13" eligible for a first level of play. The winning ticket from the first level is eligible to play in a second level for additional winnings in a "Bonus Section." A second embodiment which features a third playing level called a "Jackpot Section." The '737 patent discloses the general concept of a master winner of a multi-level progressive gaming scheme, but does not disclose the concept of a non-progression master winner.

U.S. Pat. No. 5,743,524 to Nannicola is directed to a instant ticket game system utilizing a master game seal card. Players with hold tickets ending in "13" qualify for play in a three-level modified progression scheme. To initiate play at the advanced level, a seal window is opened to reveal a winner. The winning player then competes to reach the concluding "Mountain Climber" level of the game. When a winning participate fails, a second hold card player becomes eligible to compete. This patent discloses the general concept of wider player participation in the high-level payoffs, but all participants are members of the population of original hold ticket possessors.

SUMMARY OF THE INVENTION

The present invention is directed to a seal card game system having multiple levels of integrated, non-progressive play. The game system affords the game operator an enhanced degree of player interest and enthusiasm by increasing player eligibility for a master case award level. Tickets winning the master case award level are not from the population of winning deal set tickets.

The game system comprises a case set of play tickets comprising a plurality of deal sets of play tickets and each of the plurality of deal sets of tickets comprising a plurality of play tickets. On one preferred embodiment of the present invention, the case set of tickets includes 6 deal set of tickets and each deal set of tickets includes 264 play tickets. Each play ticket includes case identifier indicia imprinted on the play ticket to identify a case set which the play ticket is a member. Each play ticket also includes deal identifier indicia imprinted on the play ticket to identify a deal set which the play ticket is a member. Each play ticket is a member of only one deal set. Each play ticket also includes a game symbol imprinted on the play ticket concealed by a removable pull tab. The pull tab is adapted to be removed by a purchaser of the play ticket.

A predetermined number of play tickets in each of the deal sets of tickets has a game symbol that qualifies the play tickets for a deal level award and for a case level award.

For each deal set, a deal winner identifier concealed by a removable pull tab identifies the play ticket from the deal qualifier game tickets that wins a deal level award. A case winner identifier concealed by a removable pull tab identifies the play ticket from the case qualifier game tickets that wins a case level award.

The game system of the present invention provides for a enhanced degree of player participation and enthusiasm throughout the course of play of a set of deals. A greater population of players are eligible for participation in a master case award level, retaining player interest. No game system in the prior art offers the advantages and features of the present invention.

Other objects and advantages and a fuller understanding of the invention will become apparent to those skilled in the art from the following detailed description of the preferred embodiments and the accompanying drawings.

DESCRIPTION OF THE PREFERRED EMBODIMENT

Figure 5:
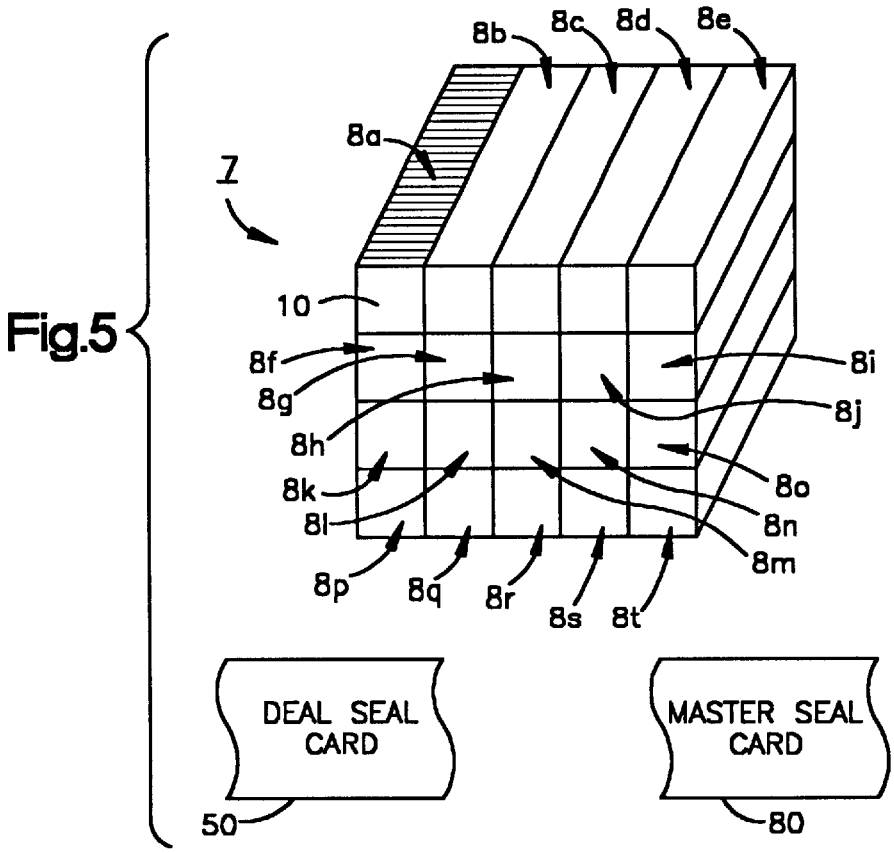
FIG. 5 is a schematic representation of a case set of seal card playing tickets, showing a game system of a first preferred embodiment.

One preferred embodiment of the present invention features a master case 7 containing a case set of play tickets. As is schematically represented in FIG. 5, each play ticket is segregated by serial number into one of a plurality of deal sets 8*a*, 8*b*, 8*c*, 8*d*, 8*e*, 8*f*, 8*g*, 8*h*, 8*i*, 8*j*, 8*k*, 8*l*, 8*m*, 8*n*, 8*o*, 8*p*, 8*q*, 8*r*, 8*s*, 8*t* (hereinafter, a deal set will be generally referred to 8). Each deal set includes a plurality of play tickets 10 and a deal seal card 50. The play tickets 10 determine eligibility to compete in a deal level award or a master case level award. A play ticket 10 either determines eligibility to participate in a deal level award, eligibility to participate in a master case award level, or is a non-participating ticket in any award level. The deal seal card 50 determines at least one winner for each deal set. A master case seal card 80 determines at least one winner for the case award level.

Figure 1A:
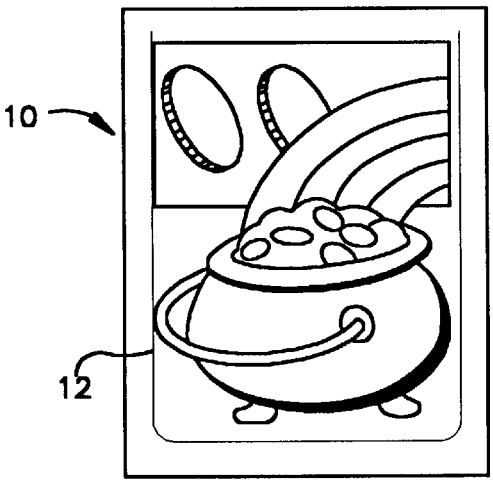
FIG. 1A is a front elevation view of a first play ticket of the present invention, showing an unopened perforated pull tab.

Referring to FIG. 1A, a front elevation view of the play ticket 10 of a first preferred embodiment is illustrated. The front side of the play ticket may feature whimsical art work. A perforated pull tab 12 is provided. After the play ticket 10 is purchased by a player, the pull tab 12 is opened by the player to reveal imprinted game symbols.

Figure 1B:
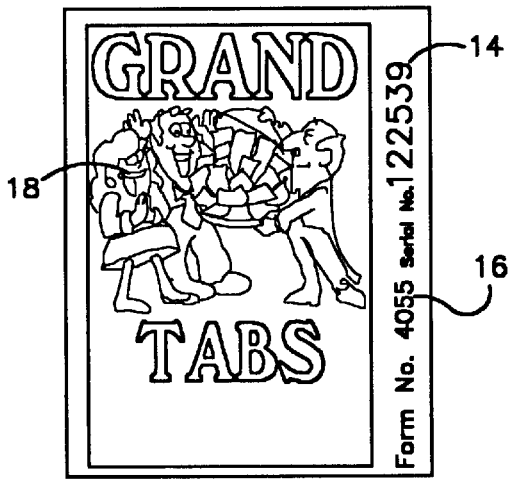
FIG. 1B is a rear elevation view of the play ticket of FIG. 1A, showing imprinted deal identifier indicia and case identifier indicia.

Referring to FIG. 1B, a rear elevation view of the play ticket 10 of FIG. 1A is illustrated. The play ticket has deal identifier indicia imprinted on the play ticket. The deal identifier indicia may be numerical, graphical, by color, or by any other suitable scheme. In the preferred embodiment, the deal identifier indicia is a serial number 14 imprinted on the rear side of the ticket 10. The serial number 14 identifies the deal set with which the play ticket 10 is associated.

All play tickets within the deal set are imprinted with the same serial number. A play ticket 10 can be associated with only one deal set. In a first preferred embodiment, each deal set 8 contains two-hundred play tickets and each case contains twenty deal sets. To be discussed in detail later, the serial numbers of every deal set 8 are imprinted on the master case seal card 80. The play ticket 10 also has a case identifier indicia imprinted on the play ticket. The case identifier indicia may be numerical, graphical, by color, or by any other suitable scheme. As illustrated in FIG. 1B, the case identifier indicia is a form number 16 imprinted on the play ticket which identifies a case set of which the play ticket is a member. Each play ticket is a member of only one case set. The form number 16 may be repeated in another case set, but the combination of the serial number 14 and the form number 16 are unique to the case set 7.

In a first preferred embodiment, schematically shown in FIG. 5, each case set 7 contains twenty deal sets and four-thousand total play tickets 10. A game operator could identify the source of a displaced or random ticket by noting the serial number 14 and the form number 16. This feature increases security to the game operator by reducing the opportunity for foul play, forgery, alteration or other mischief among participating players. Also illustrated in FIG. 1B, the play ticket 10 may also reveal a facsimile of a case qualifier game symbol 18. To be discussed later in more detail, the case qualifier game symbol 18 will qualify tickets for participation in a case award level. The case qualifier game symbol 18 is included on the rear side of the play ticket 10 to increase player knowledge of the game and generate player excitement.

Figure 2A:
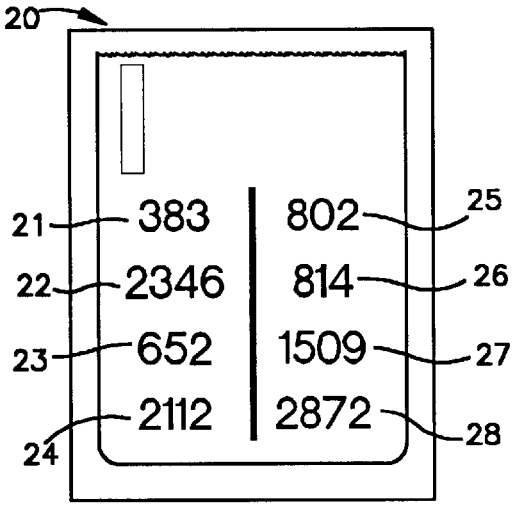
FIG. 2A is a front elevation view of the play ticket of FIG. 1A, showing imprinted game symbols revealed.
Figure 2B:
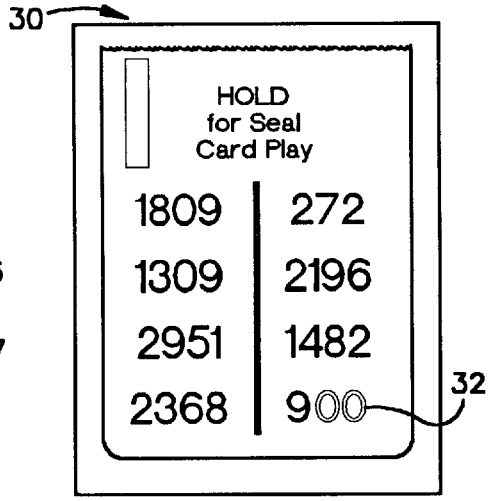
FIG. 2B is a front elevation view of a second play ticket of the present invention, showing imprinted deal qualifier game symbol revealed.
Figure 2C:
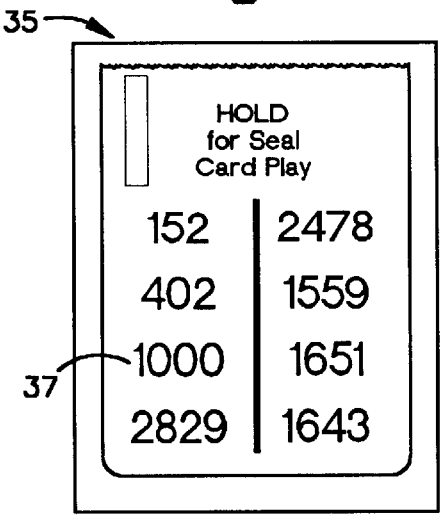
FIG. 2C is a front elevation view of a third play ticket of the present invention, showing imprinted deal qualifier game symbols revealed.

After a play ticket 10 is sold by a game operator, the player purchasing the card opens the perforated pull tab 12 to reveal imprinted game symbols. At least one game symbol is imprinted on the play ticket 10 concealed by the removable pull tab 12. The pull tab 12 is adapted to be easily removed by a purchaser of the play ticket. As illustrated in FIGS. 2A, 2B, 2C, 2D, a variety of game symbols may be revealed. All game symbols revealed are in one of three categories. A play ticket 10 either determines eligibility to: 1) participate in a deal level award, 2) eligibility to participate in a master case award level, or 3) is a non-participating award level ticket. Referring FIG. 2A, a specific play ticket 20 of the present invention is illustrated with game symbols 21–28 revealed. In the first preferred embodiment, the game symbols 21–28 are numerical combinations. A predetermined number of play tickets have a deal qualifier game symbol that qualifies those play tickets for a deal level award. The deal qualifier game symbol may be a numeric combination ending in certain digits. In one preferred embodiment, ten play tickets qualify for the deal award level. As illustrated in FIG. 2A, none of the game symbols 21–28 imprinted on the play ticket 20 are deal qualifier game symbols. The majority of play tickets reveal game symbols that do not indicate a participating ticket of any kind, either a deal qualifier game symbol or a case qualifier game symbol. Play ticket 20 is an example of such a non-participating ticket.

In the first preferred embodiment, ten play tickets qualify for the deal award level. Illustrated in FIGS. 2B, 2C, another specific play ticket 30 is illustrated containing an imprinted deal qualifier game symbol 32 and another specific play ticket 35 contains an imprinted deal qualifier game symbol 37. In the preferred embodiment, the deal qualifier game symbols are numeric. As shown, the imprinted deal qualifier game symbol are numeric symbols ending in the digits "00." In the preferred embodiment, the two ending digits are imprinted in red ink. The imprinted deal qualifier game symbol 32, 37 signify eligibility to participate in the deal award level. The deal qualifier game symbol 32, 37 do not stand alone to identify a winning ticket. In other words, the tickets 30, 35 are not "instant winner" tickets.

Figure 2D:
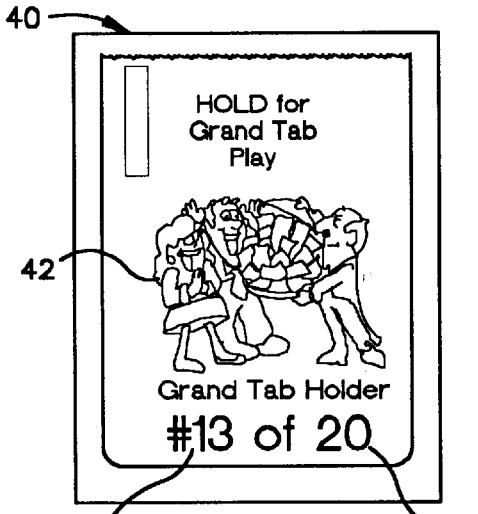
FIG. 2D is a front elevation view of a fourth play ticket of the present invention, showing imprinted case qualifier game symbols revealed.

A predetermined number of play tickets 10 in the case set 7 of tickets have a case qualifier game symbol that qualifies the play ticket for a case level award. In a first preferred embodiment, the case qualifier play tickets are mutually exclusive from the deal qualifier play tickets. In another preferred embodiment, the case qualifier play tickets and the deal qualifier play tickets may be inclusive. That is to say, a deal qualifier ticket may also be a case qualifier ticket. However, in the present invention, at least one ticket that wins at the case award level is from a population of tickets that did not win at the deal award level. Thus, the game system of the present invention is a non-progressive game system. That is, the ability of a ticket to win a case level award does not require that the ticket be a deal award winner or even a deal award qualifier. Each deal set 8 contains at least one play ticket imprinted with a case qualifier game symbol. In a first preferred embodiment, the case qualifier game symbol is graphical. As shown in FIG. 2D, another specific play ticket 40 contains a case qualifier game symbol 42. The case qualifier game symbol 42 is a graphical symbol in the preferred embodiment. In this case, the ticket graphical symbol indicate that the ticket 40 is one of twenty tickets of the case set 7 that qualifies for a case level award. A total of twenty play tickets are eligible for the case award level. The total number 46 of eligible tickets for a case level award advantageously may be indicated on a eligible play ticket 40. Each play ticket may include a further case qualifier place identifier 44 for use by the game operator in the case award level.

Each serialized deal set 8 is played out, or sold to the players, one deal set 8 at a time. In the preferred embodiment, the individual deal sets 8*a*, 8*b*, 8*c* . . . are segregated into single packages containing a plurality of play tickets 10, whereby each of the play tickets within the package is a member of the individual deal set. The deal seal card 50 associated with the individual deal set is also included. After a game operator sells all play tickets associated to a given deal set, the deal seal card 50 is used to initiate the deal award level. For each deal set 8, a deal winner identifier is concealed by a removable pull tab on the deal seal card 50. The deal winner identifier identifies a play ticket from the deal qualifier play tickets that wins a deal level award.

Figure 3A:
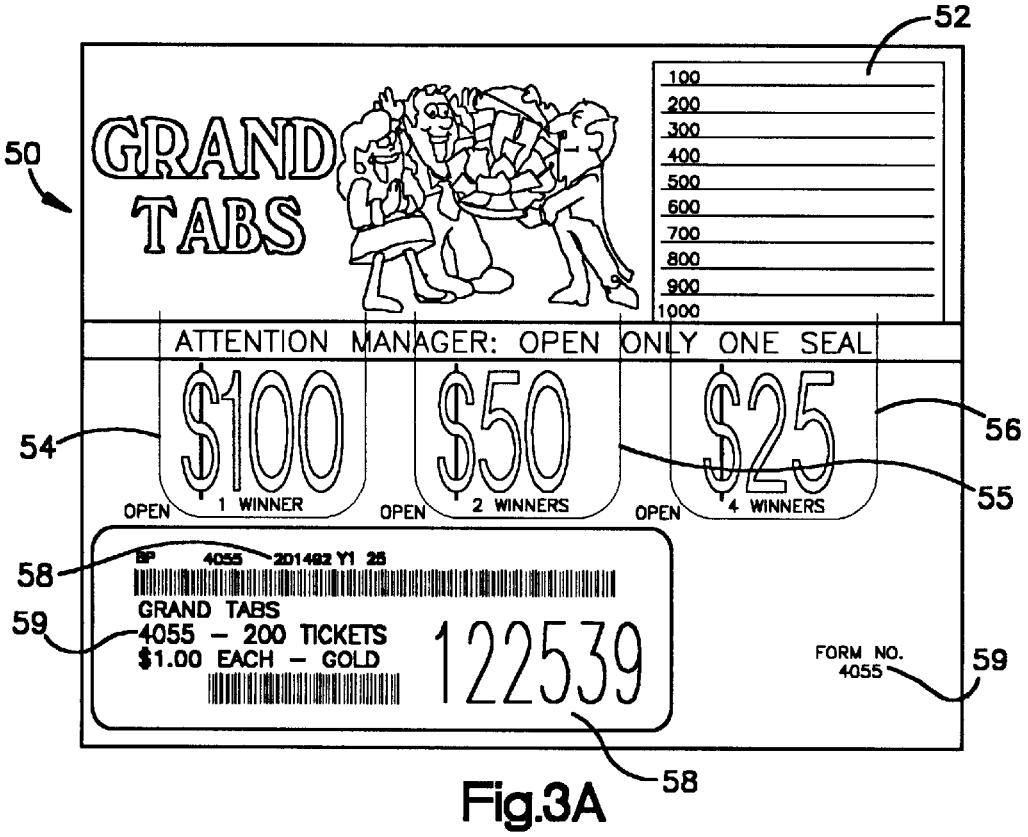
FIG. 3A is a front elevation view of a deal seal card of the present invention.

In the first embodiment, the deal seal card 50 is used, as illustrated in FIG. 3A. As shown, a separate deal seal card 50 is used for each deal set. The game operator may record the names of players in possession of deal qualifier game tickets in a recording area 52 on the deal seal card 50. A set of removable pull tabs 54, 55, 56 is also provided. Alternatively, the deal winner identifier for all deal sets within the case set may be imprinted on the single deal seal card. The game operator may chose one of any of the pull tabs to select a winner of the deal award level. One pull tab 54 will yield a single winner, while a second pull tab 55 will yield two winners, while yet a third pull tab 56 will yield four winners. The population of deal set winners split evenly a $100 deal award. Also imprinted on the deal seal card 50 in several locations are the deal identifying indicia 58 and the case identifying indicia 59. The identification of the deal serial number 58 and the case form number 59 on the deal seal card 50 provides the game operator with increased security.

Figure 3B:
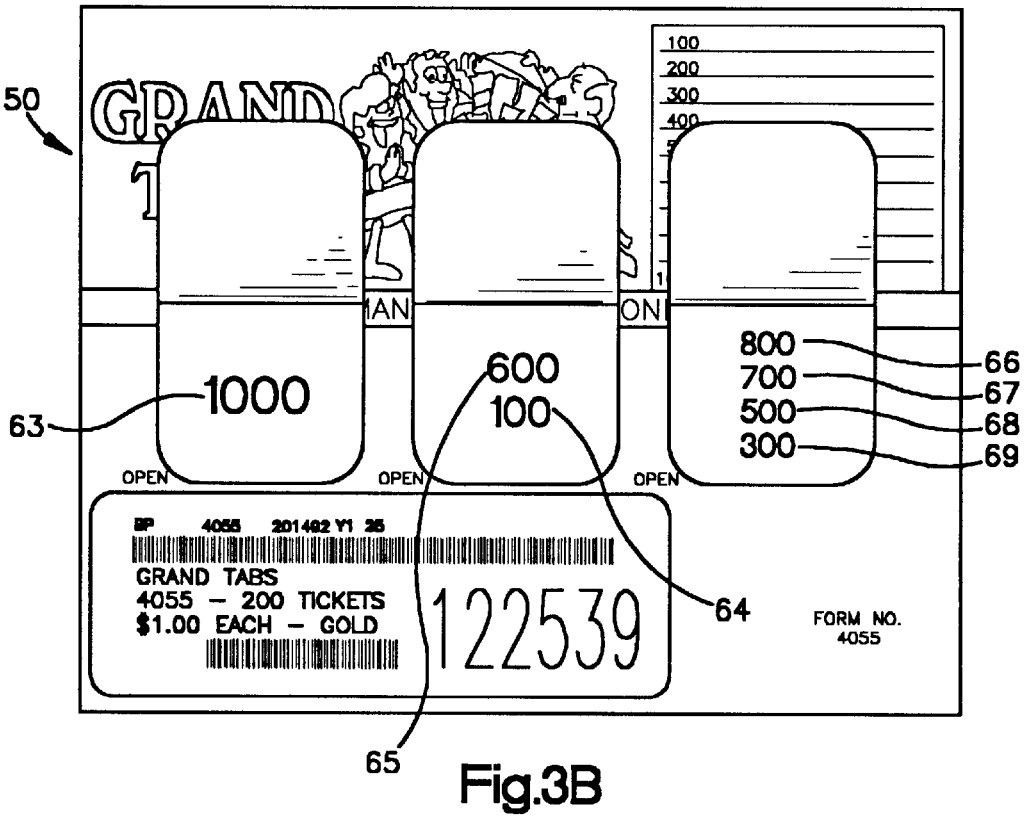
FIG. 3B is a front elevation view of the deal seal card of FIG. 3A, showing deal winner identifier revealed.

After a game operator has recorded all the names of players in possession of deal qualifier game tickets in the recording area 52, he or she may remove one of the pull tabs to reveal a deal set winner. For each deal set, the deal winner identifier is concealed by a removable pull tab. The deal winner identifier identifies a play ticket from the deal qualifier game tickets that wins a deal level award. For purposes of clarification, the deal seal card 50 in FIG. 3B is shown with all three pull tabs removed, showing deal winner identifiers 63–69. For example only, assume the game operator had chosen to award deal award to only one winner. In this example, the game operator would have opened the pull tab 54 and revealed a game winner identifier 63. The player whose name was recorded by the figure "1000" in the recording area 52, in this case, also the holder of a play ticket 35 with a deal eligible game symbol 37, would have been the deal award winner. This player would win the entire $100 prize and would not share the prize with any other player. Any other play ticket 30 with a deal eligible game symbol 32 would not be a deal award winner in this example. It should be clear the deal award winners will vary dependent on which pull tab 54, 55, 56 is opened. The choice of pull tab 54, 55, 56 will determine which deal winner identifier 63–69 is operable.

Figure 4A:
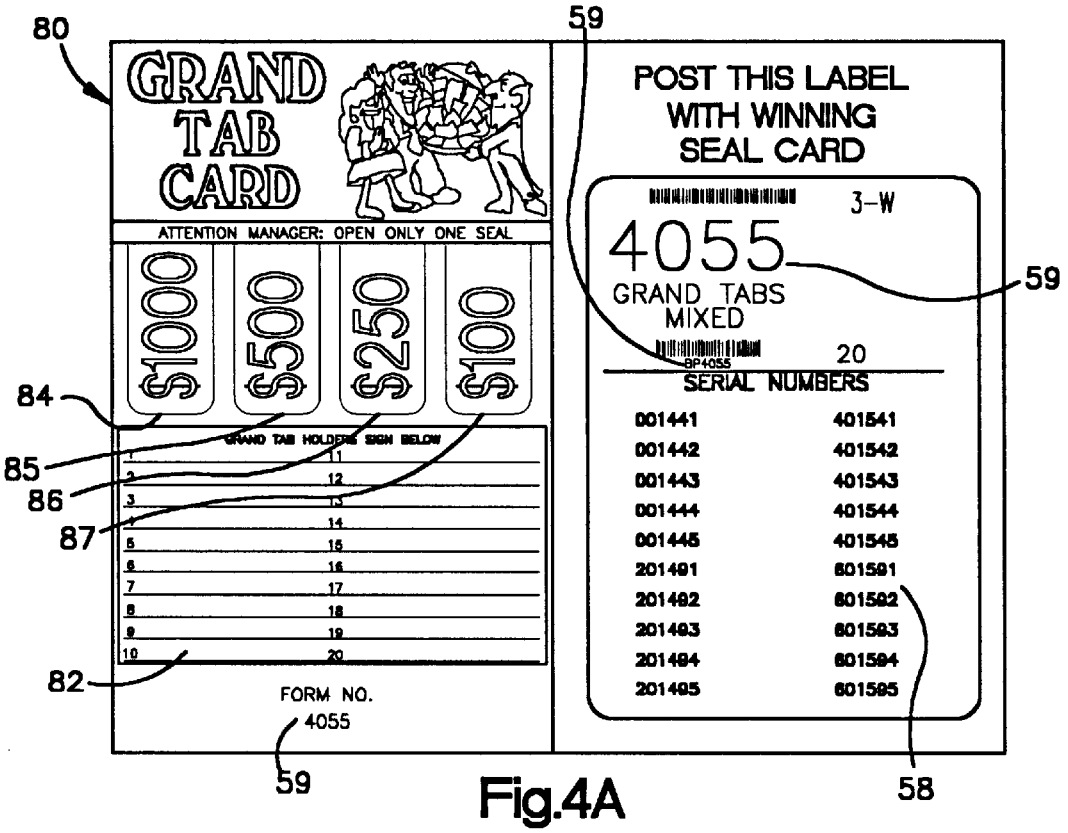
FIG. 4A is a front elevation view of a master seal card of the present invention.

After a game operator sells all play tickets 10 associated with the case set 7 and all deal play is completed, a case award level is initiated. For the case set 7, a case winner identifier imprinted on the seal card 80 is concealed by a removable pull tab. The case winner identifier identifies a play ticket from the case qualifier game tickets that wins a case level award. In one preferred embodiment, the case winner identifier is printed on a case seal card 80, as illustrated in FIG. 4A. In another embodiment, the deal winner identifiers and case winner identifier are imprinted on one case seal card.

The game operator may record the names of players in possession of case qualifier game tickets in a recording area 82. The name of the player holding the play ticket 40 shown in FIG. 2D would be recorded in the recording area 82 based on the place identifier 44 on the play ticket 40. In this example, the player's name holding the ticket 40 would be written by the number "13" on the line provided. A set of removable pull tabs 84, 85, 86, 87 is also provided. The game operator may chose one of any of the pull tabs to select a winner of the case award level. One pull tab 84 will yield a single winner, a second pull tab 85 will yield two winners, while yet a third pull tab 86 will yield four winners, and a fourth pull tab 87 will yield ten winners.

The population of case award winners split evenly a $1,000 case award. Also imprinted on the case seal card 80 in several locations are the deal identifying indicia 58 and the case identifying indicia 59. The identification of the deal serial number 58 and the case form number 59 on the case seal card 80 provides the game operator with increased security. The deal identifying indicia may be imprinted on the case seal card 80. As shown in FIG. 4A, in the preferred embodiment, the serial numbers of all twenty deal sets associated with the case are imprinted on the case seal card 80. This further heightens the security of the game operator against foul play or human error.

Figure 4B:
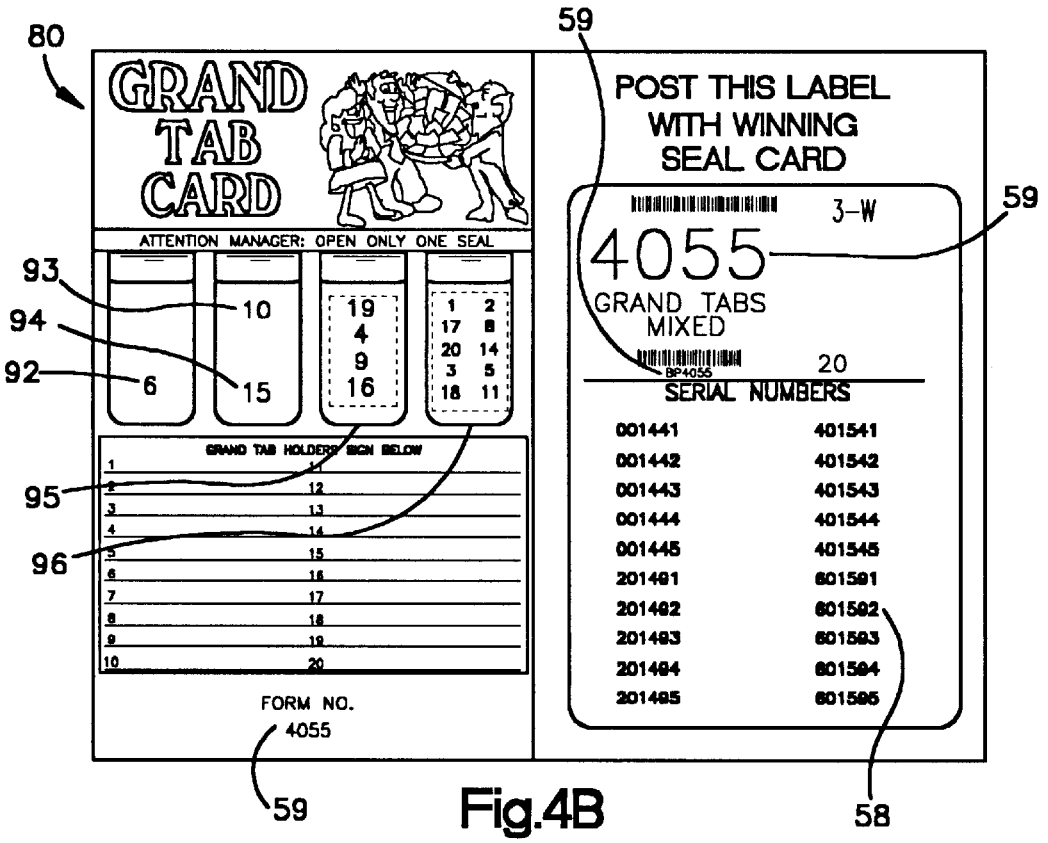
FIG. 4B is a front elevation view of the master seal card of FIG. 4A, showing case winner identifier revealed.

A case winner identifier identifies a play ticket from the case qualifier game tickets that wins a case level award. The case winner identifier is concealed by a removable pull tab. In the preferred embodiment, after a game operator has recorded all the names of players in possession of case qualifier game tickets in the recording area 82, he or she may remove one of the pull tabs to reveal a case set winner. For each case set, the case winner identifier is concealed by a removable pull tab. For purposes of clarification, a case seal card 80 in FIG. 4B is shown with all three pull tabs removed, showing deal winner identifiers 92–96. For example only, assume the game operator had chosen to award the case award to only one winner. In this example, the game operator would have opened the pull tab 84 and revealed a single game winner identifier 92. The player whose name was recorded by the place identifier "6" in the recording area 82 would have been the case award winner. The player win the $1,000 case award. Any other play ticket 40 with a case eligible game symbol 42 would not be a case award winner in this example. It should be clear the case award winners will vary dependent of which pull tab 84, 85, 86, 87 is opened. The choice of pull tab 84, 85, 86, 87 determines which case winner identifier 92–96 is operable.

Second Preferred Embodiment

Figure 6:
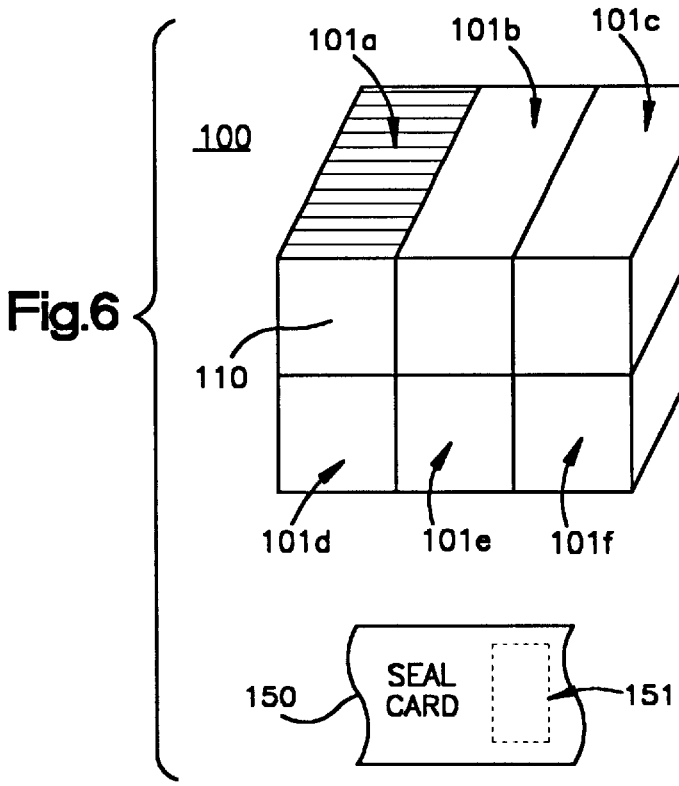
FIG. 6 is a schematic representation of a case set of seal card playing tickets, showing a game system of a second preferred embodiment.

A second preferred embodiment of the seal card game system of the present invention features a master case 100 containing a case set of play tickets. As is schematically represented in FIG. 6, each play ticket is segregated by color into one of a plurality of deal sets 101*a*, 101*b*, 101*c*, 101*d*, 101*e* and 101*f* (hereinafter in the discussion of the second preferred embodiment, a deal set will be generally referred to 101) Each deal set 101 includes a plurality of play tickets 110.

In the second preferred embodiment of the present invention the play tickets 110 are color coded by deal set 101, that is, the play tickets of a particular deal set are all imprinted with a common color, but each deal set has a different color. For example, all the play tickets of the deal set 101*a* may have the color red imprinted thereon, while all the play tickets of the deal set 101*b* may have the color blue imprinted thereon, while all the play tickets of the deal set 101*c* may have the color orange imprinted thereon, etc.

The play tickets 110 determine eligibility to compete in a deal level award and a master case level award. A play ticket 110 either determines eligibility to participate in a deal level award and a master case award level, or is a non-participating ticket in any award level. The seal card 150 determines at least one winner for each deal set and at least one winner for the case award level.

Figure 7A:
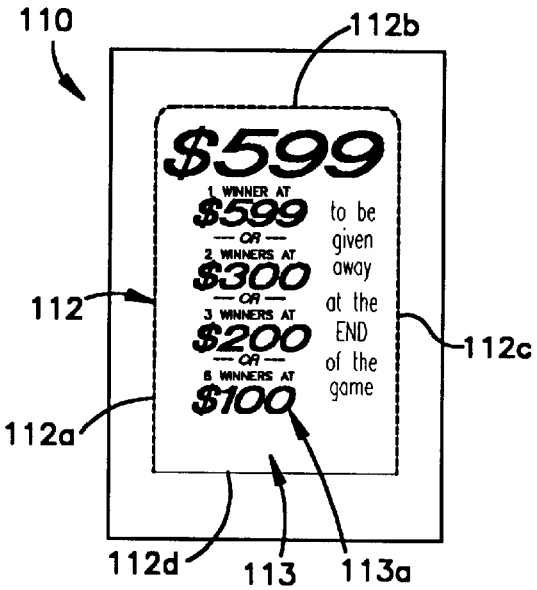
FIG. 7A is a front elevation view of a fifth play ticket of the present invention, showing an unopened perforated pull tab and deal identifier indicia.

Referring to FIG. 7A, a front elevation view of the play ticket 110 of a second preferred embodiment is illustrated. A perforated pull tab 112 is provided. After the play ticket 110 is purchased by a player, the pull tab 112 is opened by the player to reveal imprinted game symbols. The play ticket 110 has deal identifier indicia 113 imprinted on the play ticket. The deal identifier indicia 113 in the second preferred embodiment of the present invention, as shown in FIG. 6A, is a color 113*a*. All text on the front side of the ticket 110 is imprinted in a certain color 113*a* (e.g., purple) thereby identifying the deal set 101 with which the ticket 110 is a member. That is to say, the ticket 110 is a member of the deal set 101 in which the deal identifier indicia 113 is the color purple 113*a*. As a result, the ticket 110 is a member of "the purple deal set."

Figure 7B:
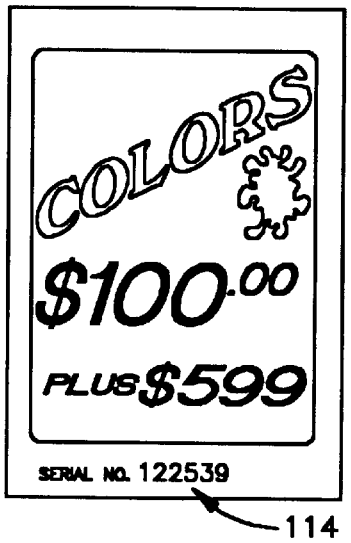
FIG. 7B is a rear elevation view of the play ticket of FIG. 6A, showing imprinted case identifier indicia.

Referring to FIG. 7B, a rear elevation view of the play ticket 110 of FIG. 6A is illustrated. The case identifying indicia 114 identifies the case set with which the play ticket 110 is associated (e.g., "122539"). All play tickets within the case set 100 are imprinted with the same serial number 114. A play ticket 110 can be associated with only one deal set 101 and only one case set 100. The combination of the deal identifying indicia 113*a* and the serial number 114 are unique to the case set 110.

In one exemplary embodiment of the second preferred embodiment, each deal set contains two-hundred sixty-four play tickets 110 and each case contains six deal sets 101. Schematically shown in FIG. 6, each case set 100 contains one-thousand five-hundred eighty-four total play tickets 110. A game operator could identify the source of a displaced or random ticket by noting the serial number 114. This feature increases security to the game operator by reducing the opportunity for foul play, forgery, alteration or other mischief among participating players.

Figure 7C:
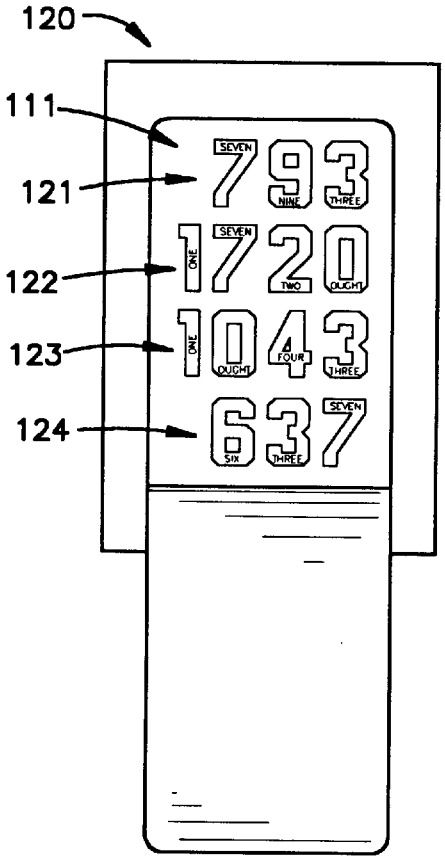
FIG. 7C is a front elevation view of a sixth play ticket of FIG. 6A, showing imprinted game symbols revealed.
Figure 7D:
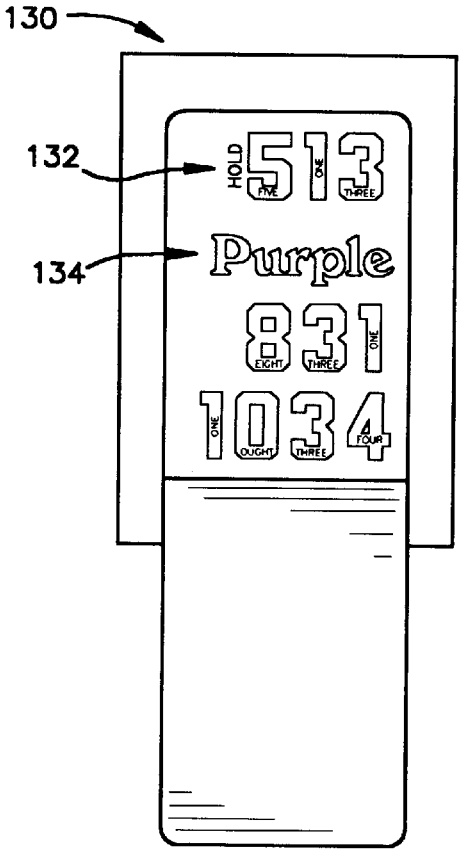
FIG. 7D is a front elevation view of a seventh play ticket of the present invention, showing imprinted qualifier game symbol revealed and deal identifier indicia.

After a play ticket 110 is sold by a game operator, the player purchasing the card opens the perforated pull tab 112 to reveal one or more imprinted game symbols under the pull tab 112. At least one game symbol is imprinted on the play ticket 110 in an area 111 (FIG. 7C) concealed by the removable pull tab 112. The pull tab 112 has a perforated border extending along three sides 112*a*, 112*b*, 112*c* and folds back, or is scored, along a fourth non-perforated side 112*d*, as can be seen in FIGS. 7C and 7D which shown play tickets with the pull tab 112 folded back. The pull tab 112 is adapted to be easily ripped and folded back by a purchaser of the play ticket. As illustrated in FIGS. 7C and 7D, a variety of game symbols may be revealed in the area 111. All game symbols revealed are in one of two categories. A play ticket 110 either determines eligibility to: 1) participate in one deal level award, and in a master case award level, or 2) is a non-participating award level ticket. Referring FIG. 7C, a specific play ticket 120 of the present invention is illustrated with game symbols 121, 122, 123, 124 revealed.

In the second preferred embodiment, the game symbols 121–124 are numerical combinations. A predetermined number of play tickets have a qualifier game symbol that qualifies those play tickets for a deal level award. The deal qualifier game symbol may be a numeric combination ending in certain digits. In one exemplary embodiment, twelve play tickets qualify for the deal award level. As illustrated in FIG. 7C, none of the game symbols 121–124 imprinted on the play ticket 120 are deal qualifier game symbols. The majority of play tickets reveal game symbols that do not indicate a participating ticket game symbol. Play ticket 120 is an example of such a non-participating ticket.

In one exemplary embodiment of the second preferred embodiment, twelve play tickets qualify for the deal award level. Illustrated in FIG. 7D, another specific play ticket 130 is illustrated containing an imprinted qualifier game symbol 132 ("HOLD 513"). In the preferred embodiment, the qualifier game symbols are numeric. As shown, the imprinted deal qualifier game symbol are numeric symbols ending in the digits "13." In the preferred embodiment, the digits of the game symbols 132 are imprinted in an ink color in accordance the deal identifier indicia color 113*a* associated with the deal set, e.g., the purple set. The color of the deal identifier indicia color 113*a* may also advantageously be printed, as shown at 134, in the ticket area 111. The imprinted deal qualifier game symbol 132 signifies eligibility to participate in the "purple deal set" award level and the case award level. The deal qualifier game symbol 132 does not stand alone to identify a winning ticket. In other words, play tickets of the seal card game system are not "instant winner" tickets.

In an exemplary embodiment of the second preferred embodiment, the case qualifier play tickets and the deal qualifier play tickets may be the same tickets. The case qualifier play tickets and the deal qualifier play tickets may be the same tickets. Alternatively, the case qualifier play tickets and the deal qualifier play tickets may be mutually exclusive. That is to say, a deal qualifier ticket may not be a case qualifier ticket.

In the game system of the present invention, at least one ticket that wins at the case award level is from a population of tickets that did not win at the deal award level. Thus, the game system of the present invention is a non-progressive game system. That is, the ability of a ticket to win a case level award does not require that the ticket be a deal award winner.

Each identified deal set is played out, or sold to the players, one deal set 101 at a time. In an exemplary embodiment of the second preferred embodiment, the individual deal sets 101*a*, 101*b*, 101*c*, 101*d*, 101*e*, 101*f* are segregated into single packages containing a plurality of play tickets 110, whereby each of the play tickets within the package is a member of the individual deal set. The seal card 150 (FIG. 6) is associated with the case and the individual deal sets within the case. After a game operator sells all play tickets associated to a given deal set, the seal card 150 is used to initiate the individual deal award level. For each deal set 101, a deal winner identifier for each deal is concealed by one or more removable pull tab 154*a*, 154*b*, 154*c*, 154*d*, 154*e*, 154*f* (FIG. 8A) on the seal card 150. The deal winner identifier identifies a play ticket from the deal qualifier play tickets that wins a deal level award.

Figure 8A:
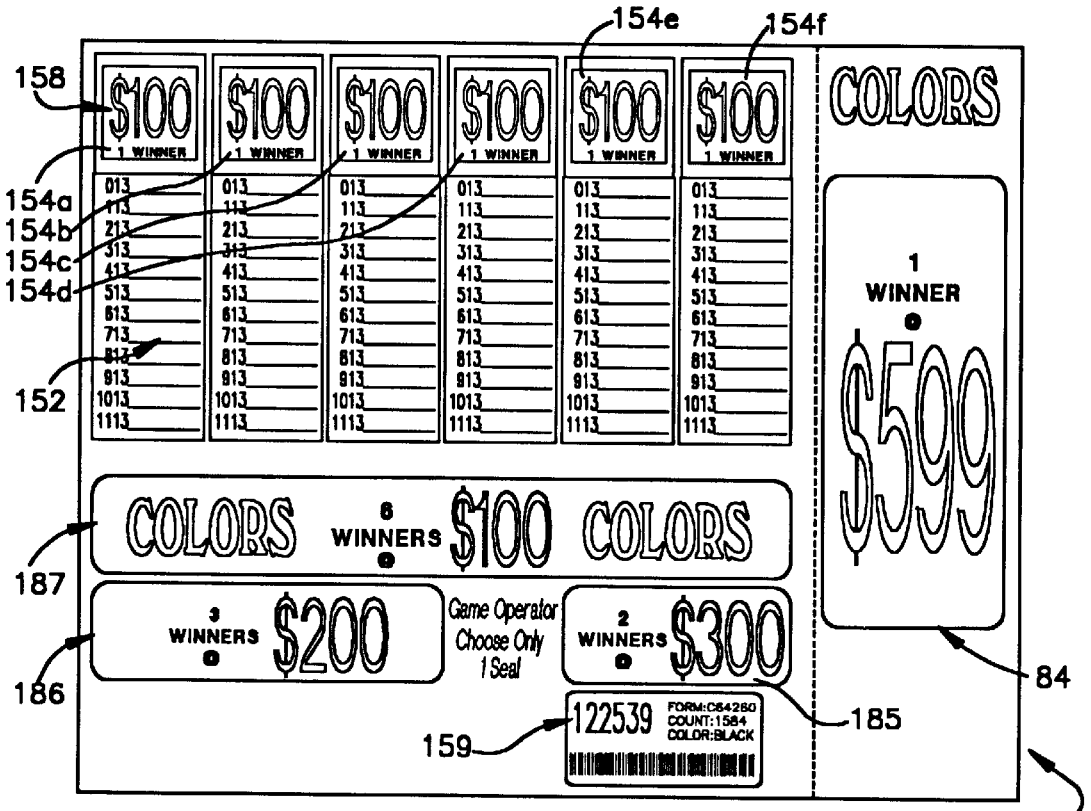
FIG. 8A is a front elevation view of a seal card of the present invention.

In the second embodiment, the seal card 150 is used, as illustrated in FIG. 8A. As shown, a single seal card 150 is used for all deal sets 101*a*, 101*b*, 101*c*, 101*d*, 101*e*, 101*f*. The game operator may record the names of players in possession of deal qualifier game tickets in a recording area 152 on the seal card 150. The removable pull tabs 154*a*, 154*b*, 154*c*, 154*d*, 154*e*, 154*f* are also provided for each deal. The game operator removes the pull tabs 154*a*, 154*b*, 154*c*, 154*d*, 154*e*, 154*f* to select a winner of the deal award level from the corresponding deal sets 101*a*, 101*b*, 101*c*, 101*d*, 101*e*, 101*f*. The deal set winner for each deal set is awarded a $100 deal award. Also imprinted on the seal card 150 in several locations are deal identifying indicia 158 (e.g., a "$100" symbol imprinted with an ink color in accordance with the deal set identifying indicia color) and the case identifying indicia 159, The identification of the case serial number 159 on the seal card 150 provides the game operator with increased security against foul play, human error or other mischief.

Figure 8B:
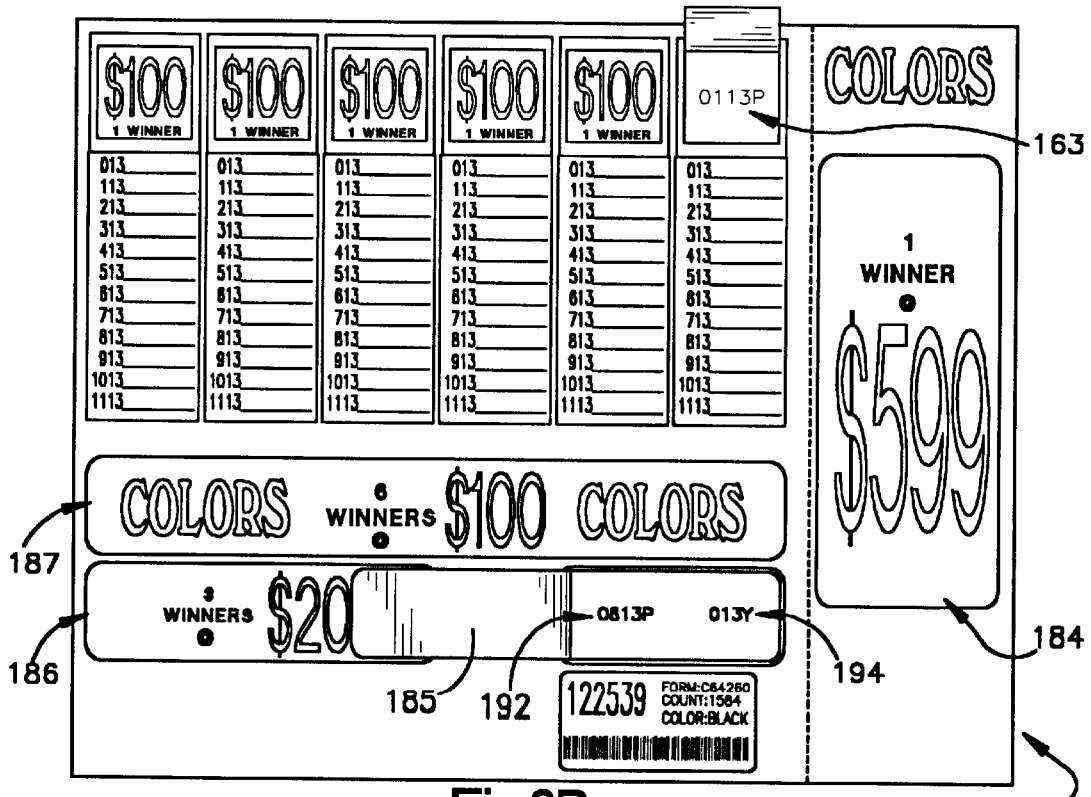
FIG. 8B is a front elevation view of the seal card of FIG. 7A, showing deal winner identifier and case winner identified revealed.

After a game operator has recorded all the names of players in possession of deal qualifier game tickets in the recording area 152, he or she may remove the pull tabs 154*a*, 154*b*, 154*c*, 154*d*, 154*e*, 154*f* to reveal a deal set winner. For each deal set, the deal winner identifier is concealed by the removable pull tab tabs 154*a*, 154*b*, 154*c*, 154*d*, 154*e*, 154*f*. The deal winner identifier identifies a play ticket from the deal qualifier game tickets that wins a deal level award. The seal card 150 in FIG. 8B is shown with the pull tab 154*f* removed, showing a deal winner identifier 163. The player holding the ticket with the deal winner identifier 163 (e.g., "0113P") would win the entire $100 prize. In an exemplary embodiment of the second preferred embodiment, the deal award winning ticket can not win at the case level.

After a game operator sells all play tickets 110 associated with the case set 100 and all deal play is completed, a case award level is initiated. For the case set 100, a case winner identifier imprinted on the seal card 150 is concealed by a removable pull tab. The case winner identifier identifies a play ticket from the qualifier game tickets that wins a case level award. In one preferred embodiment, the case winner identifier is printed on a seal card 150, as illustrated in FIG. 8A and 8B. No extra money is required to participate at the case award level.

A set of removable pull tabs 184, 185, 186, 187 is provided. The game operator may chose one of any of the pull tabs to select a winner of the case award level. One pull tab 184 will yield a single winner, a second pull tab 185 will yield two winners, while yet a third pull tab 186 will yield three winners, and a fourth pull tab 187 will yield six winners. The population of multiple case award winners split evenly a $600 case award. The single case winner is awarded $599 in selected by the game operator.

A case winner identifier identifies a play ticket from the case qualifier game tickets that wins a case level award. The case winner identifier is concealed by one or more removable pull tabs 184, 185, 186, 187. In an exemplary embodiment, a game operator may remove one of the pull tabs 184, 185, 186, 187 of his or her choice to reveal a case set winner.

In the exemplary embodiment of the case card 150 shown in FIG. 8A, the operator is provided with four case level award options. If pull tab 184 is selected to be pulled by the operator, one case level award will be awarded (one playing ticket would win the case level award). If pull tab 185 is pulled by the operator, two case level awards will be awarded (two playing tickets will share the case level award). If pull tab 186 is pulled by the operator, three case level awards will be awarded (three playing tickets will share the case level award). If pull tab 187 is pulled by the operator, six case level awards will be awarded (six playing tickets will share the case level award).

For each case set, the case winner identifier is concealed by a removable pull tab 184, 185, 186, 187. For purposes of example only, a seal card 150 in FIG. 8B is shown with one pull tab 185 removed, showing deal winner identifiers 192, 196. For example only, assume the game operator had chosen to award the case award to two winners. In this example, the game operator would have opened the pull tab 185 and revealed a game winner identifiers 192 ("0813P"), 196 ("013Y"). The player or players holding the tickets with the game winner identifiers 192, 196 would be the case award winners and the players would share the $600 case award. It should be understood the case award winners will vary dependent of which pull tab 184, 185, 186, 187 is opened. The choice of pull tab 184, 185, 186, 187 determines which case winner identifier is operable.

Many variations and modifications of the invention will be apparent to those skilled in the art from the above detailed description. Therefore, it is to be understood that, within the scope of the appended claims, the invention can be practiced otherwise than as specifically shown and described.

What is claimed is:

1. A seal card game system providing multiple levels of non-progressive play, the system comprising:

a) a case set of tickets comprising a plurality of deal sets of tickets and each of the plurality of deal sets of tickets comprising a plurality of play tickets;

b) each of the plurality of play tickets including:

i) deal identifier indicia imprinted on the play ticket to identify a deal set which the play ticket is a member of, each play ticket being a member of only one deal set, wherein said deal identifier indicia is a selected color imprinted on ticket;

ii) case identifier indicia imprinted on the play ticket to identify a case set which the play ticket is a member of each play ticket being a member of only one case set; and iii) at least one game symbol imprinted on the play ticket concealed by a removable pull tab, the pull tab adapted to be removed by a purchaser of the play ticket;

c) a predetermined number of, play tickets in each of the plurality of deal sets of tickets having a qualifier game symbol that qualifies said play tickets to participate for a deal level award and a case level award;

d) for each deal set, a deal winner identifier concealed by a removable pull tab, the deal winner identifier identifying at least one play ticket from the qualifier play tickets that wins a deal level award;

e) a case winner identifier concealed by a removable pull tab, the case winner identifier identifying at least one play ticket from the qualifier play tickets that wins a case level award; and f) at least one play ticket that wins a case level award being mutually exclusive from play tickets that won a deal level award.

2. The seal card game system of claim 1 wherein the deal winner identifiers and case winner identifier are imprinted on at least one seal card.

3. The seal card game system of claim 1 wherein the deal winner identifiers and case winner identifier are imprinted on a seal card, wherein said seal card is imprinted with a selected color indicating a deal set with which the seal card is associated and a case identifier indicia indicating a case set with which the seal card is associated.

4. The seal card game system of claim 1 wherein the qualifier game symbol is numerical.

5. The seal card game system of claim 1 wherein the qualifier game symbol is graphical.

6. The seal card game system of claim 1 wherein each deal set includes at least one qualifier play ticket.

7. The seal card game system of claim 1 wherein the number of play tickets in a deal set is 264 and the number of deal sets in the case set is 6.

8. The seal card game system of claim 1 wherein each deal set includes 12 deal qualifier play tickets.

9. The seal card game system of claim 1 wherein for each deal set, there is a deal winner identifier concealed by a removable pull tab, each deal winner identifier identifying at least one play ticket from the qualifier game tickets that win a deal level award.

10. The seal card game system of claim 1 wherein there are at least one case winner identifier concealed by one or more removable pull tabs each case winner identifier identifying at least one play ticket from the qualifier game tickets that wins a case level award.

11. The seal card game system of claim 1 wherein the deal identifier indicia is numerical.

12. The seal card game system of claim 1 wherein the deal identifier indicia is graphical.

13. The seal card game system of claim 1 wherein a name of said selected color is imprinted in an area of said play ticket where game symbols are printed, indicating a deal set with which the play ticket is associated.

14. The seal card game system of claim 1 wherein said qualifier game symbols are imprinted with said selected color, indicating a deal set with which the play ticket is associated.

15. The seal card game system of claim 1 wherein text of a playing ticket is imprinted with said selected color, indicating a deal set with which the play ticket is associated.

16. A method of playing a non-progressive seal card game system:

a) providing a case set of tickets comprising a plurality of deal sets of tickets and each of the plurality of deal sets of tickets comprising a plurality of play tickets wherein each of the plurality of play tickets includes:

i) a case identifier indicia imprinted on the play ticket to identify a case set which the play ticket is a member of, each play ticket being a member of only one case set;

ii) a deal identifier indicia imprinted on the play ticket to identify a deal set which the play ticket is a member of, each play ticket being a member of only one deal set, wherein said deal identifier indicia is a selected color imprinted on ticket; and iii) at least one game symbol imprinted on the play ticket concealed by a removable pull tab, the pull tab adapted to be removed by a purchaser of the play ticket;

b) providing a predetermined number of play tickets in each of the plurality of deal sets of tickets having a qualifier game symbol that qualifies said play tickets for a deal level award and a case level award;

c) providing, for each deal set, a deal winner identifier concealed by a removable pull tab, the deal winner identifier identifying a play ticket from the qualifier play tickets that wins a deal level award;

d) providing a case winner identifier concealed by a removable pull tab, the case winner identifier identifying a play ticket from the qualifier play tickets that wins a case level award;

e) selling the play tickets of a deal set to players;

f) having said players remove said pull tabs to reveal said game symbols;

g) recording players in possession of play tickets imprinted with said qualifier game symbol that qualifies said play tickets for a deal level award;

h) awarding at least one deal set winner for each said deal set;

i) playing out all remaining deal sets; and j) awarding at least one case set winner for said case set, wherein each said play ticket from the qualifier play tickets that wins a deal level award and at least one of said play ticket from the qualifier game tickets that wins a case level award being mutually exclusive tickets.

17. The method of claim 16 wherein each said deal set is segregated into a package comprising a plurality of play tickets, whereby each of said plurality of play tickets is a member of said deal set.

* * * * *